United States Patent [19]

Ammann

[11] 4,101,919

[45] Jul. 18, 1978

[54] FILM PROCESSING APPARATUS

[75] Inventor: Steve Ammann, Cupertino, Calif.

[73] Assignee: Quantor Corporation, Mountain View, Calif.

[21] Appl. No.: 710,838

[22] Filed: Aug. 2, 1976

[51] Int. Cl.[2] ..... G03D 3/08

[52] U.S. Cl. ..... 354/319; 354/324

[58] Field of Search ..... 354/324–326, 354/317–322, 338; 138/39, 37

[56] References Cited

U.S. PATENT DOCUMENTS

| | | | |
|---|---|---|---|
| 1,974,110 | 9/1934 | Higley | 138/39 |
| 3,372,630 | 3/1968 | Schmidt | 354/321 X |
| 3,545,364 | 12/1970 | Reedy et al. | 354/319 |
| 3,752,054 | 8/1973 | Scanlan | 354/317 |
| 3,774,521 | 11/1973 | Beck | 354/317 |
| 3,986,191 | 10/1976 | Ackermann et al. | 354/324 |

FOREIGN PATENT DOCUMENTS

| | | | |
|---|---|---|---|
| 196,680 | 3/1958 | Austria | 138/39 |

*Primary Examiner*—Richard L. Moses
*Attorney, Agent, or Firm*—Townsend and Townsend

[57] ABSTRACT

Processing apparatus for developing exposed film by sequentially subjecting an emulsion side of the film to processing liquids. The processor has an elongate, horizontally disposed tank divided into a plurality of serially arranged compartments for holding the liquid. The film emulsion side faces downwardly and passes over a nozzle plate disposed between the film and a drainage opening for each compartment which forms a processing liquid curtain that contacts every part of the film's emulsion side. A cover plate on top of the film guides the film and includes longitudinally extending pressure-relieving grooves to prevent the film from adhering to the plate. The drainage opening for each compartment is slanted and a processing fluid return line guides the fluid from the compartment to a collection point for recirculation. The return conduit has a sufficiently large diameter so that the returning liquid does not fill the complete cross-section of the conduit. A spirally wound member is disposed in the conduit and liquid flowing from the drainage opening to the collection point flows at a relatively low speed along the spirally wound member. The apparatus also includes film drive rollers positioned between adjacent compartments which advance the film and simultaneously remove therefrom processing fluid before the film enters the next compartment.

12 Claims, 5 Drawing Figures

FILM PROCESSING APPARATUS

BACKGROUND OF THE INVENTION

The present invention relates to equipment for developing exposed photographic film and in particular, to equipment adapted to process a large film volume. The present invention is particularly adapted for use in connection with automatic film exposing and developing equipment such as is used in the rapidly expanding field of micro-image recordation in which a large volume of data is recorded on relatively small film, usually referred to as "microfiche". One particularly advantageous microfiche recorder is claimed and described in the commonly owned U.S. Pat. No. 3,746,444 in which a microfiche, after its exposure, is automatically severed from a supply spool and fed to a film processor where the exposed emulsion side of the film is sequentially subjected to the usual processing liquids. Thereafter the fiche is dried and ready for use.

Although the specific construction of the film processor is not described in detail in the above-referenced U.S. patent, processors as such are well-known in the art. U.S. Pat. Nos. 3,192,846; 3,344,729; 3,405,626; and 3,545,964 describe recent attempts to construct efficient, high-speed automatic film processors.

Although the processors described in the referenced patents constitute certain improvements over earlier automatic processors, they have a number of shortcomings. For example, the prior art processors attempt to flood the whole fiche, that is, normally both sides thereof, with processing liquid while it is normally only necessary to subject the emulsion side of the fiche to the liquid. This flooding of the fiche is wasteful of processing liquid and, more importantly, requires a relatively complicated liquid distribution and collection system. This renders such processors unnecessarily expensive.

Furthermore, prior art processors exercise little control over the return of the processing liquid to a collection point, e.g., a collection bottle disposed beneath the processor as such. Normally a drainage opening is provided for each processing compartment which is connected with the collection bottle via a suitable conduit such as a plastic hose. The liquid is permitted to run freely from the compartment to the bottle. The hose diameter is relatively large to prevent debris that might collect therein from blocking the hose and to prevent the formation of flow blocking air bubbles (such as are sometimes experienced in conventional sink drains) at the drainage hole. As a consequence, the liquid was permitted to gravitationally cascade through the hose into the bottle. This turbulent, uncontrolled flow of processing liquid has a tendency to draw air into the conduit and, sometimes, into the bottle. Since certain of the processing liquids oxidize this construction of the drainage system could prematurely render the liquid useless and require its replacement due only to oxidation caused by air entrapments. Again, this is expensive and increases the overall cost of operating prior art processors.

Additionally, prior art processors were relatively cumbersome to maintain and frequently required lengthy disassembly for normal service. This resulted in increased service costs and prolonged machine downtimes which again is highly undesirable, particularly for the high volume operations normally associated with automatic film processors. Furthermore, the fiche sometimes wedged as it was transported through the processor. This could lead to a jamming which required the opening of the processor and the manual, time-consuming removal of the jammed fiche. Similarly, prior art processors often had large, flat surfaces, past which the fiche travelled. Even slight pressure differentials between the fiche sides could cause the fiche to adhere to such a surface and effectively render it immovable, again requiring the time-consuming and expensive opening of the processor.

SUMMARY OF THE INVENTION

The present invention provides an improved film or fiche processor which is a substantial improvement over the prior art and eliminates many of the heretofore encountered shortcomings.

Generally speaking, a michrofiche processor constructed in accordance with the present invention has a substantially horizontally positioned tank, preferably of a unitary construction, defined by lateral side walls and a plurality of transverse bulkheads which divide the tank into a plurality of serially arranged compartments for sequentially subjecting a fiche passing therethrough to different processing liquids.

A nozzle plate is disposed in each compartment and has an upwardly facing slit that extends over the full width of the microfiche passing through the processor.

Pressurized processing liquid is discharged from the slit in an upward direction to thereby fully and completely contact an emulsion side of the fiche with the processing liquid. A cover plate is disposed on top of the nozzle plate and restrains the fiche to and guides it along its predetermined travel path through the processor. The cover plate includes longitudinally extending pressure-relieving grooves which face the nozzle plate and prevent slight pressure differentials from causing the fiche to stick against the cover plate.

A pair of cooperating, fiche advancing and liquid removing roller pairs is disposed on each side of the nozzle plate in each compartment. The rollers of each pair are rotated in opposite directions and they are faced with a resilient material, such as rubber, to squeegy processing liquid from the fiche before it enters the next compartment. An intermixing of different processing liquids is thereby prevented. A closure plate is releasably placed over the tank and closes the tank interior from the exterior. The plate rests directly on the tank walls and is constructed to permit slight vertical movements of the cover plate relative to the closure plate.

Each compartment includes a slanted drainage opening, that is, a drainage opening that is angularly inclined from the vertical. A liquid return conduit, such as a flexible plastic hose, connects the drainage opening with a collection point, e.g., a liquid collecting container for recirculation of the liquid to the nozzle plate.

Liquid is permitted to gravitationally flow through the return hose which has a sufficiently large diameter so that the liquid flowing therein occupies less than a full cross-section of the hose. To prevent the liquid from cascading in an uncontrolled manner from the drainage opening to the collection bottle, flow regulating means is disposed within the hose for flowing the liquid in a substantially laminar flow and at a speed that is less than the normal, gravity induced speed of the liquid in the hose. This is accomplished by placing within the hose a spirally wound member in contact with the inner wall of the hose. Instead of cascading through the hose, liquid entering the hose immediately contacts the spiral member and flows in a spiral pattern therealong over a path length that is much greater than the length of the hose and at a speed which is much less than the speed of the liquid if no spiral member had been placed inside the hose. In this manner, uncontrolled, turbulent flow is transformed into a smooth, laminar flow and the inclusion of liquid oxidizing air bubbles is prevented.

Furthermore, the slanted drainage opening has the advantage of preventing the formation of the above-discussed flow blocking bubbles at the entrance to the passageway. Instead of liquid bridging a vertically oriented drainage opening the liquid dribbles from the compartment along the lowermost edge of the drainage opening into the return hose. Since the diameter of the drainage opening is greater than is necessary for accomodating the normal liquid flow, the formation of flow blocking bubbles is prevented.

Thus, the present invention assures a better operation of the processor, prevents an accidental overfilling of the compartment with processing liquid due to a poor liquid drainage, and provides for no or only negligible liquid oxidation. This latter aspect in turn enables one to utilize the processing liquid until its usefulness has been exhausted by time or by the number of fiche treated instead of by uncontrolled oxidation as was the case in the past.

In addition to the improved operating characteristics and reduced operating costs, the microfiche processor of the present invention significantly simplifies normal maintenance and servicing. The processor is wholly enclosed within a unitary tank closed by a closure plate secured to the tank with quick release fasteners. Sets of adjacent roller pairs are constructed to define a unitary assembly that is simply dropped in place and that can be instantaneously withdrawn for cleaning, servicing and the like. Moreover, processor failures due to a jammed fiche in the processor, either because of a wedging of the fiche or because pressure differentials between the two sides of the fiche cause it to adhere to a large surface, are prevented. Expensive machine downtimes and service calls caused by such failures, which were common in the past, are thereby eliminated.

Thus, it is apparent that the present invention provides an automatic microfiche processor which constitutes a substantial improvement over the prior art and which, in particular, reduces its operating and maintenance costs significantly. ,

DESCRIPTION OF THE PREFERRED EMBODIMENTS

Figure 1:
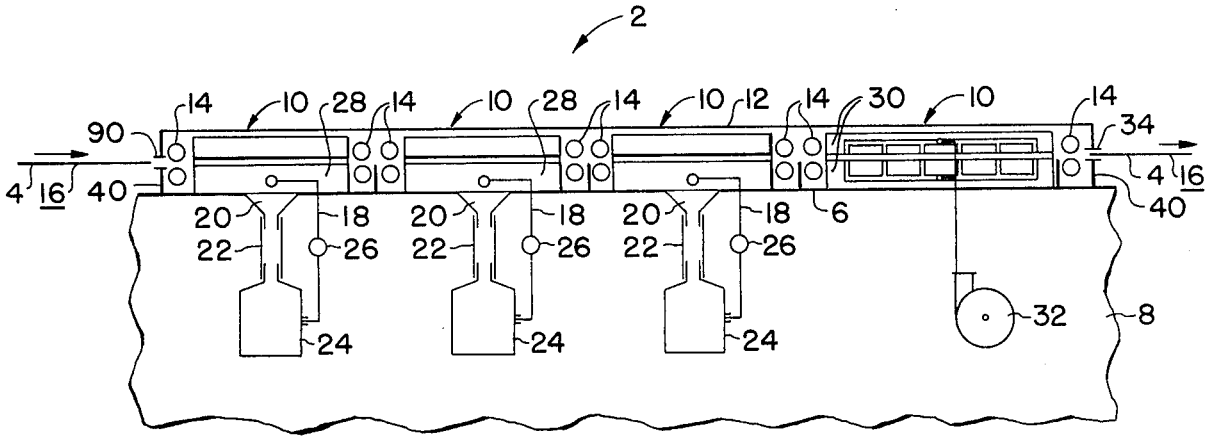
FIG. 1 is a side elevational, schematic view of a microfiche processor constructed in accordance with the present invention.
Figure 2:
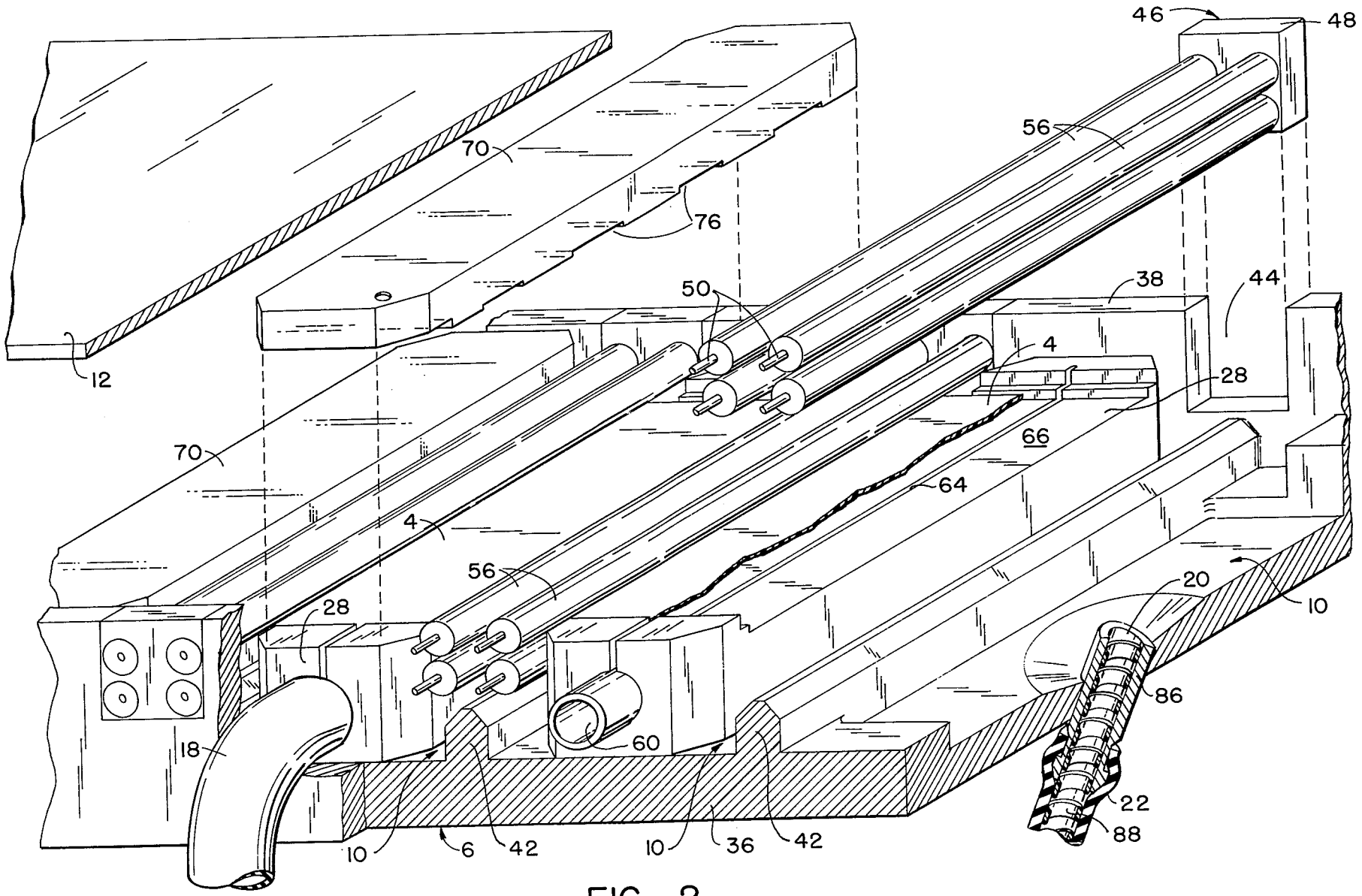
FIG. 2 is an exploded, side elevational view with parts broken away, illustrating the microfiche processor of the present invention in greater detail.
Figure 3:
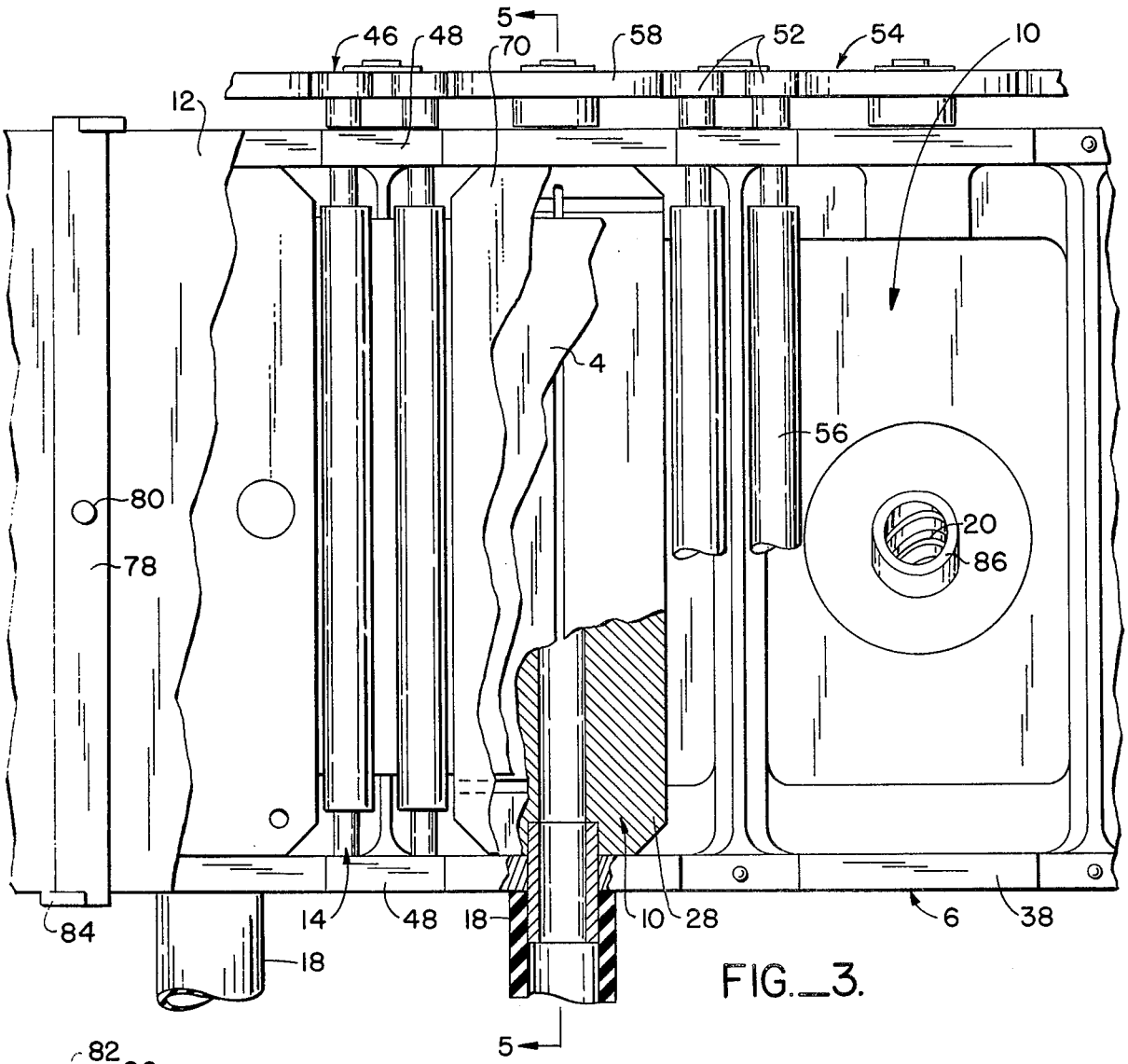
FIG. 3 is a fragmentary plan view, with parts broken away, of the microfiche processor shown in FIG. 2.
Figure 4:
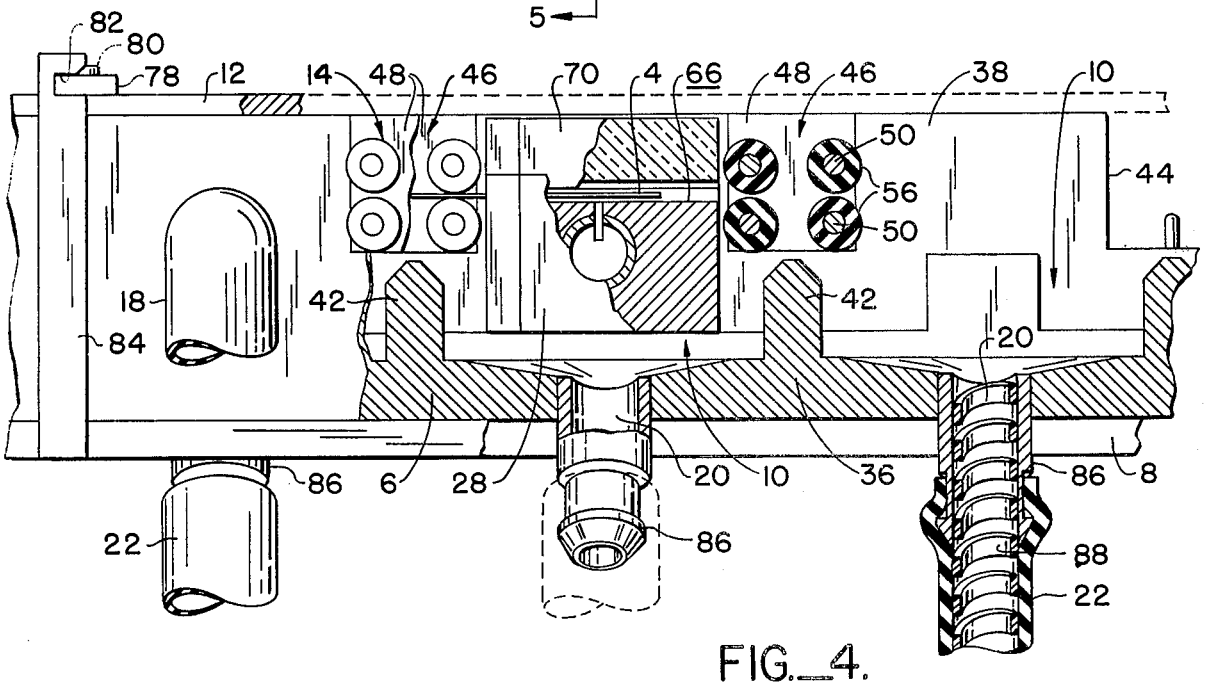
FIG. 4 is a fragmentary front elevational view, with parts broken away, of the microfiche processor shown in FIGS. 2 and 3.

Referring first to FIG. 1, a microfiche processor 2 for developing, fixing and drying an exposed microfiche 4 generally comprises an elongate, horizontally disposed tank 6 carried by a support structure 8 which may, for example, be part of a microfiche recorder/processor such as the one described in the above-referenced U.S. Pat. No. 3,746,444. The tank is divided into a plurality of serially arranged compartments 10 and it is closed with a releasably secured closure plate 12. Drive means such as roller pairs 14 advance the microfiche through the compartments so that its emulsion side 16 faces downwardly. In the compartment the fiche, and particulary its emulsion side is treated with the usual processing liquids for developing and fixing photographic film. The processing liquid for each compartment is stored in a storage and supply container 24 and it is circulated between the supply container and the respective compartment by a circulation pump 26 via a supply line 18, a fluid discharge nozzle plate 28 disposed within each compartment, a compartment drainage opening 20 and a drainage conduit 22 which returns the liquid to the supply container. As the roller pairs successively advance the fiche through the compartments the emulsion side of the fiche is sequentially exposed to the proper processing liquids. In the last compartment the fully developed and fixed fiche is dried. For that purpose, the last compartment includes a pair of opposing duct plates 30 connected with a hot air fan 32 so that the wet film is dried before it exits the processor and, thereby, is available for immediate use.

Referring now to FIGS. 1–5, tank 6 is defined by an essentially flat, horizontal bottom plate 36, pairs of opposing, perpendicular and upwardly extending side and end walls 38, 40 respectively and a plurality of spaced-apart, upwardly extending intermediate bulkheads 42 which define and separate the compartments 10 from each other. For purposes more fully described hereinafter, the bulkheads have a height substantially less than the height of the side walls. Preferably, the tank is of a unitary construction as, for example, by molding a suitable plastic material.

The side walls include opposing cutouts 44 which are aligned with the bulkheads and which receive fiche drive assemblies 46 each of which includes two sets of roller pairs 14. The roller assemblies include end plates 48 which rotatably mount the rollers and which fit snugly into side wall cutouts 44 so that each assembly can be removed therefrom by simply lifting it out of the cutouts. It will be observed that each roller pair of each assembly straddles a bulkhead 42 so that one roller pair of the assembly is disposed within each of the two compartments 10 adjoining a given bulkhead.

Roller shafts 50 protrudes from one of the end plates of each roller assembly and they are fitted with suitably constructed and dimensioned gears 52 which form part of a gear train 56 extending over the length of the tank side wall 38 for rotating the rollers of each pair in opposing directions. A fiche 4 placed between a roller pair is thereby advanced in a downstream direction, that is from left to right as viewed in FIGS. 1–4, along a horizontal path defined by the contacting peripheries of the roller pairs and located slightly above bulkheads 42.

Each roller includes a resiliently compressible periphery, preferably a sleeve 56 carried by shaft 50 and constructed of a rubber-like material. The sleeves have a diameter so that when a fiche passes between a pair of rollers the sleeves squeegy any liquid droplets that may adhere to the fiche therefrom. In this manner, liquid from one compartment is always removed from the fiche before the fiche enters the next adjacent compartment and an intermixing of liquids from the compartments is prevented.

The gear train 56 is preferably driven via a drive gear 58 which is in turn driven by a motor (not shown) suitably mounted to support structure 8. To prevent damage to the processor, it is preferred that a torque responsive clutch is interposed between the motor and the drive gear which slips when more than a predetermined torque is required by the gear train. The construction of such clutches is well-known and therefore not described herein.

Disposed within each compartment 10 (except for the last compartment housing the duct plates 30) is the earlier mentioned nozzle plate 28 which rests on tank ledges 59 and which has a length substantially equal to the width of the tank and, therewith the compartment 10. Each nozzle plate includes a bore 60 which also extends over substantially the full width of the compartment and which is connected to processing liquid supply hose 18 via a tube 62 that extends through tank side wall 38. The nozzle plate further includes a transverse slit 64 which fluidly communicates nozzle bore 60 with the upwardly facing side 66 of the plate so that a liquid curtain is discharged from the slit when pressurized fluid is supplied to the nozzle bar. When a fiche 4 passes through the compartment and pressurized liquid is supplied to the nozzle plate the liquid curtain discharged by slit 64 subjects the emulsion side 16 of the fiche to processing liquid.

Figure 5:
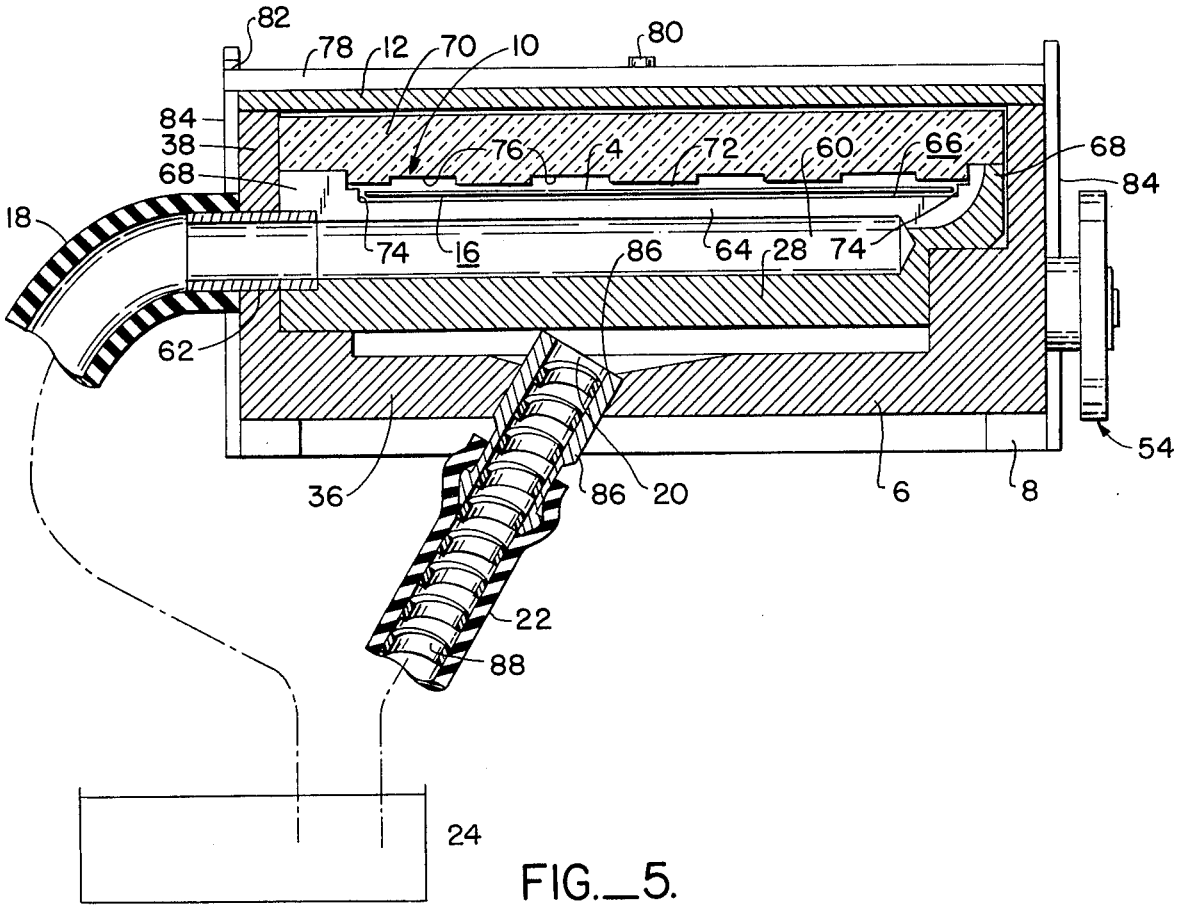
FIG. 5 is a side elevational view, in section, and is taken on line 5—5 of FIG. 3.

As is best seen in FIG. 5 lateral ends 68 of the nozzle plate adjacent side walls 38 of the tank project upwardly above the travel path of fiche 4 and supports a cover plate 70 above the nozzle plate. The portion of the nozzle plate intermediate the lateral ends 68 is further stepped down so as to define a passageway 72 for the fiche between the cover plate and the nozzle plate. Lateral guide surfaces 74 of the nozzle plate are spaced-apart slightly more than the width of the fiche passing through passageway 72 so that the fiche can readily pass through it while its forward movement is closely controlled and guided over substantially the full length of the tank to prevent its accidental wedging and a possible jamming resulting therefrom.

Cover plate 70 has a rectangular configuration and its downwardly facing side includes a plurality of longitudinally (in the direction of fiche movement) extending recessed grooves 76. The grooves serve to prevent slight pressure differentials between the two fiche sides from causing the fiche to adhere to the cover plate. If this should occur further fiche movement through the processor is effectively prevented which can, in turn, result in a jamming of the processor.

To facilitate the movement of the fiche through the compartments, the combined stack height of the nozzle plate and the cover plate is further less than the effective height of tank side walls 38 so that closure plate 12 is spaced from cover plate 70 and the cover plate is permitted slight vertical movement. In this manner, momentary buckling of the film is taken up by a corresponding vertical movement of the cover plate and the possibility of fiche jamming is substantially reduced or eliminated.

To provide ready access to the interior of the processor, closure plate 12 is releasably secured to the tank; preferably via a quick-release connection such as a plurality of locking arms 78 secured to the top surface of the closure plate and pivotable about vertical mounting shafts 80. The outer ends of the locking arm engage oppositely facing slots 82 in upright locking posts 84 extending from support structure 8 along the outer surface of tank side walls 38. In this manner, the locking arms can be rotated between closure plate releasing and securing positions for the quick removal of the closure plate and a ready, unobstructed access to the interior of the processor 2 of the present invention for inspection, servicing or repair.

Processing liquid supplied to the chambers via nozzle plates 28 is withdrawn from the chambers through drainage openings 20. The drainage openings are slanted, that is their axes are inclined relative to the vertical (as best seen in FIG. 5) and in the preferred embodiment, a tubular hose connector 86 is mounted, e.g. bonded into bottom 36 of the tank. Drainage conduit 22 is preferably a flexible, e.g. plastic hose, which is conventionally attached to the free, downwardly protruding ends of the hose connector. The other hose end is secured to supply and storage container 24 in a conventional manner. To prevent a relatively small liquid flow, that is a liquid flow which does not fully occupy the cross-section of the drainage hose 22 from cascading through the hose and from thereby drawing with it processing liquid oxidizing air, a spiral member 88 is disposed within each hose or, at least, within each hose which receives oxidizing liquid.

In the preferred embodiment of the invention, the spiral member has a rectangular cross-section and a pitch so that the edges of the spiral member are closely adjacent but spaced from each other. In this manner, processing liquid flowing from a compartment 10 to the storage container 24 flows in a spiral pattern along the spiral member 88 instead of parallel to the axis of the hose. A turbulent, cascading liquid flow is thus replaced by a smooth, laminar liquid flow. Further, since the travel length of the liquids (which is about equal to the full length of the spiral member) is much greater than the hose length, the flow speed is reduced, thereby further contributing to a smooth, laminar flow. Air entrapments that are frequently carried along in a cascading flow are eliminated and processing liquid vapors along (rather than a vapor-air mixture) will fill the portions of the storage container and the supply hose not occupied by liquid. Undesirable liquid oxidation and the need for a premature replacement of the liquid due to its oxidation are thus prevented.

The operation of the processor 2 of the present invention should now be apparent. To briefly summarize it, before processing commences, processing liquid supply pumps 26 are energized to circulate processing liquid from supply containers 24 via supply lines 18 to nozzle plates 28 to discharge a processing liquid curtain from the upwardly facing slits 64 in the nozzle plates. The liquid curtain extends over the full width of the film passageway 72 between the nozzle plate and its associated cover plate. Also, air blower 32 is energized to discharge heated air from duct plates 30. An exposed fiche 4 is now introduced into the processor through intake opening 90 (see FIG. 1). Gear train 54 rotates the shaft 50 of each roller pair 14 in opposite directions so that the leading edge of the fiche introduced through the intake opening is grasped by the first roller pair and advanced into the passageway 72 (between nozzle plate 28 and cover plate 70) in the first compartment 10. As the fiche passes over slit 64 in the nozzle plate its emulsion side 16 is flooded with processing fluid discharged from the slit. Thereafter, the leading edge is grasped by the first roller pair 14 of the roller assembly 46 between the first and second tank compartments. Due to the compression of the resilient roller sleeves 56, any processing liquid from the first compartment adhering to the fiche is squeeged therefrom. Removed liquid drops downwardly for drainage through the drainage opening 20 in the first compartment. As the fiche enters the second compartment, therefore, it is free of processing liquid from the first compartment, thereby preventing an undesirable intermixing of the liquids. The same process as occurred in the first compartment is repeated in the second and succeeding compartments until the film is fully developed and fixed. Finally, the film passes through the last, drying compartment of the tank and is discharged through opening 34 for immediate use.

As already briefly mentioned, processing liquid is recirculated by draining it from the compartment through drainage opening 20 and permitting it to relatively slowly flow towards supply container 24 along spiral member 88 in a laminar, non-turbulent flow. It should also be observed that the slanted drainage opening causes liquid to be removed from the compartment to flow into the hose connector 86 over the lowermost edge 92 of the connector (see FIG. 5). This prevents the otherwise possible formation of flow blocking air or gas entrapments (as can be sometimes the case when the pipe is vertically oriented) at the entrance to the drainage pipe. A constant and complete drainage of the compartments is thereby achieved and the possibility of an accumultion of excess liquid in the compartment which, in an extreme case, may spill over the bulkheads 42 into the adjacent processing compartments is thereby prevented. A better operation of the processor is thus assured.

Also, it should be observed that the close guidance of the film by the nozzle plate 28 and the cover plate 70 as well as the provision of longitudinal grooves 76 in the cover plate prevent possible wedging or sticking of the fiche and the possibility of a resulting jamming. In addition, the "floating" mounting of the cover plate helps to accommodate temporary buckling of the fiche and thereby helps to prevent a scratching of portions of the film surface by either the nozzle plate or the cover plate.

When servicing, cleaning or inspection is required the processor of the present invention provides ready access by simply opening locking arms 78 in the above described manner and removing closure plate 12 from the tank. All elements within the tank, that is the nozzle plate and the cover plate are readily removable, the former by first disconnecting supply hose 18 and tube 62. The elements are equally quickly replaced and the processor is ready for use within minutes, thereby eliminating time-consuming and costly labor and machine downtimes.

I claim:

1. A film processor for treating a length of film with different processing liquids comprising: a support frame; a tank carried by the frame defining a plurality of serially arranged compartments and means for separating the compartments to prevent a liquid flow between the compartments; means for passing the film length past the compartments, the last mentioned means including liquid removal means for substantially completely removing from the film any liquid adhering to the film before the film enters a compartment; liquid introduction means for each compartment comprising means for flowing the liquid over at least one side of the film; and liquid removal means for each compartment comprising a drainage opening defined by a tubular passage this is slanted with respect to the vertical and a substantially cylindrical drainage communicating the opening with a fluid collection point located below the compartment so that liquid from the compartment can gravitationally flow through the opening and the tube to the collection point, the passage and the tube having a sufficiently large cross-section so that liquid flowing therein only partially fills the cross-section of the passage and the tube during normal operation of the liquid introduction means, and a spirally wound member disposed within, in contact with an interior wall of, constructed separately of the tube extending over substantially the full length of the tube and having an end terminating proximate the passage for guiding the liquid therein along a spiral path that is longer than the tube between the compartment and the collection point to prevent air from being drawn into the tube and a resulting oxidation of the liquid in the tube a portion of the spirally wound member proximate the passage being further in contact with a relatively lower side of the passage to assure that the liquid entering the passage is contacted by the member and flows therealong in a laminar flow pattern.

2. A film processor according to claim 1 wherein the film transport means comprises cooperating roller pairs between which the film passes, and means for driving the roller pairs in opposite directions to thereby advance the film length past the compartments.

3. A film processor according to claim 2 wherein the liquid removal means comprises a layer of resilient material applied to the rollers, wherein the rollers extend perpendicularly to the film travel direction across the film, and including means for biasing the cooperating rollers against the film so that the resilient layers of the cooperating rollers squeegy any liquid adhering to the film therefrom before the film enters the next adjacent compartment.

4. A film processor according to claim 3 including a plurality of adjacent roller pairs disposed between each pair of adjacent compartments, wherein the compartment separating means comprises bulkhead means between adjacent compartments constructed so as to permit the passage of film between the compartments, and wherein one roller pair of the plurality of adjacent roller pairs is disposed proximate one side of the bulkhead means facing one of the adjacent compartments, and the other roller pair of the plurality of adjacent roller pairs is disposed proximate another side of the bulkhead means between adjacent compartments.

5. A film processor according to claim 4 wherein the plurality of adjacent roller pairs comprise at least two roller pairs, and including means mounting the at least two roller pairs to the tank for their simultaneous removal from and installation in the tank to thereby facilitate the servicing of the tank and of the roller pairs.

6. A film processor according to claim 1 wherein the liquid introduction means comprises a nozzle plate for each compartment disposed between the film and the drainage passage, the nozzle plate including an interior conduit, means for connecting the conduit with a liquid supply source, and liquid discharge nozzle means in fluid communication with the conduit, extending transversely to the direction of film movement over the width of the film, and facing the film so that a liquid curtain is flowed over a film side facing the nozzle plate as the film moves past the nozzle means.

7. A film processor according to claim 6 including a top plate placed over the film and supported by the nozzle plate, the top plate including a plurality of grooves facing the film and extending parallel to the direction of film movement to prevent an adherence of the film to the top plate.

8. A film processor according to claim 7 wherein the nozzle plate and the top plate define parallel, laterally spaced-apart film guiding surfaces spaced a distance substantially equal to the width of the film length so that film edges are constrained by the surfaces and the film is guided substantially linearly through the processor.

9. A film processor for developing exposed film by sequentially contacting an emulsion side of the film with a plurality of processing liquids, the processor comprising:

an elongate, substantially horizontal tank having a plurality of serially arranged compartments separated from each other by upright side walls to prevent the liquids from flowing between the compartments, the tank including a drainage opening for each compartment;

means for transporting the film in a substantially horizontal path past the side walls and the compartments;

nozzle means for each compartment disposed between an underside of the film and the drainage opening of that compartment, the nozzle means being constructed to contact every part of the film underside with processing liquid as the film moves past the corresponding compartment;

a cover plate disposed adjacent an upwardly facing side of the film and means for supporting the cover plate so that the film can move between the cover plate and the nozzle means, the cover plate including a plurality of depressions on its side facing the film to prevent film from adhering to the cover plate as it moves past it;

means for removing processing liquid from the film before the film enters the next adjacent compartment to prevent an intermixing of the liquids;

stationary means extending over substantially the full length of the tank and engaging lateral edges of the film as it moves through the processor for guiding the film along a straight, substantially horizontal path;

a closure member disposed over the cover plates and closing each compartment from the exterior, means for securing the closure member to the tank, and means for spacing the closure member from the cover plate so that the cover plate is movable relative to the closure member.

10. A film processor according to claim 9 wherein the drainage opening is defined by a passageway disposed at a lowermost point of each compartment and leading to a collection point for processing liquid withdrawn from the compartment, the passageway being angularly inclined relative to the vertical at least in the vicinity of the compartment to prevent the formation of air bubbles in the passageway and to thereby prevent an oxidation of the processing liquid.

11. A film processor according to claim 10 including an elongate member disposed in the passageway and extending from the drainage opening to the collection point, the elongate member being non-parallel to the axis of the passageway.

12. A microfiche processor for developing an emulsion side of the fiche comprising:

an elongate tank and support means for substantially horizontally positioning the tank, the tank including lateral side walls and a plurality of transverse bulkheads dividing the tank into a plurality of serially arranged compartments for holding different processing liquids, each compartment including a slanted drainage opening;

a nozzle plate disposed in each compartment and having an upwardly facing slit extending over the width of the fiche passing through the tank, and means for supplying processing liquids under pressure to the slit for the discharge therefrom in an upward direction;

a cover plate disposed on top of the nozzle plate, the cover plate including longitudinally extending pressure relieving grooves facing the nozzle plate;

means for spacing the cover plate from the nozzle plate by a distance slightly greater than the thickness of the fiche so that a fiche can pass between the plates;

a pair of cooperating, film advancing and liquid removing roller pairs on each side of the nozzle plate in each compartment, means for rotating the rollers of each roller pair in opposing directions so that film disposed between the rollers pairs is advanced through the space between the nozzle plate and the cover plate and processing liquid adhering to the film is removed therefrom before the fiche enters the next compartment;

means for rotating the roller pairs;

a closure plate carried by the side walls of the tank and spaced from the closure plate so that the cover plate is movable in a vertical direction relative to the closure plate;

means releasably securing the closure plate to the tank; and hose means connected to the slanted drainage opening and extending downwardly therefrom into a processing liquid container disposed below the tank, the hose means including means defining a continuous spiral path between the drainage opening and the container so that liquid entering the hose means flows along the spiral path in a substantially laminar flow pattern without entrapping air and causing such air to oxidize the processing liquid.

* * * * *